United States Patent [19]

Roudebush

[11] 3,957,173

[45] May 18, 1976

[54] USER ACCESS COMPARTMENT FOR AN AUTOMATED TELLER MACHINE

[75] Inventor: Melvin T. Roudebush, Dayton, Ohio

[73] Assignee: NCR Corporation, Dayton, Ohio

[22] Filed: June 26, 1974

[21] Appl. No.: 483,472

[52] U.S. Cl. ..... 221/15; 109/19; 109/68; 194/DIG. 26

[51] Int. Cl.[2] ..... E05G 7/00

[58] Field of Search ..... 109/19, 66–68; 232/44, 43.1–43.4, 1 E; 194/DIG. 9, DIG. 6, 4, DIG. 26; 221/15

[56] References Cited

UNITED STATES PATENTS

| | | | |
|---|---|---|---|
| 1,885,165 | 11/1932 | Willems | 109/19 |
| 2,577,401 | 12/1951 | Calcutt et al. | 232/1 E |
| 3,114,499 | 12/1963 | Graber et al. | 232/44 |
| 3,487,905 | 1/1970 | James | 194/4 |
| 3,675,816 | 7/1972 | Bourke et al. | 221/13 |
| 3,707,261 | 12/1972 | Cutter | 232/44 |

*Primary Examiner*—Robert B. Reeves
*Assistant Examiner*—Francis J. Bartuska
*Attorney, Agent, or Firm*—J. T. Cavender; Albert L. Sessler, Jr.; Elmer Wargo

[57] ABSTRACT

A user access compartment for an automated teller machine which dispenses currency and/or receipts through an opening in the protective cabinet of the machine. The compartment is generally cylindrical in shape having an access opening therein, and the compartment is pivotally mounted on a frame located in the machine. A currency dispenser located in the machine dispenses currency into the compartment upon command from a valid customer of the machine. An arcuately shaped door panel normally closes the opening in the cabinet. To dispense the currency requested by a valid customer, the compartment with the currency therein is unlocked and is rotated to align the access opening of the compartment with the opening in the protective cabinet, and the compartment is locked in the dispensing position, and thereafter, the door panel is unlocked and is rotated to an open position permitting the customer to reach into the access opening of the compartment to withdraw the currency he requested along with an associated transaction receipt. After a predetermined amount of elapsed time, the user access compartment is closed by first closing and locking the door panel in the closed position, and thereafter, the compartment is rotated in the opposite direction to dump any contents remaining therein into a special collecting bin located within the machine.

17 Claims, 8 Drawing Figures

USER ACCESS COMPARTMENT FOR AN AUTOMATED TELLER MACHINE

BACKGROUND OF THE INVENTION

This invention relates to an automated teller machine which is actuated by a coded document and more particularly, it relates to a user access compartment which conveys items, like cash from a currency dispenser located in the machine to a user or customer.

In recent years, the banking industry has been attempting to influence the general public to use fewer checks in their financial transactions due to difficulties in processing large amounts of checks and paperwork. Part of the problem has been alleviated by providing branch banks (to provide cash transactions), but branch banks are expensive to maintain.

Efforts are now being made to induce the general public to use automated teller machines like automatic currency dispensing machines which make cash available to bank customers on a 24 hour basis. These machines are generally operated by a credit card and promise to make the banking service cheaper than the expensive branch banks.

Naturally, to be acceptable to the public, the automated teller machines must be reliable, must accurately dispense money, must be simple to operate, and must be almost fool-proof in operation. Additionally, to be acceptable to the banking industry, the machines must be tamperproof and provide security for the cash stored therein.

To operate an automated teller machine, a credit card is normally inserted into the machine, and the user enters certain data (user codes, quantity of cash desired, type of transaction etc.) upon a keyboard associated with the machine. The machine will then process the transaction, update the user's account to reflect the current transaction, dispense cash if necessary, and return the card to the user as part of a routine operation.

The present invention is utilized to deliver items like cash from a currency dispenser located within an automated teller machine and/or receipts to a customer in response to a valid transaction.

An object of this invention is to produce a user access compartment module which may be used with an automated teller machine.

Another object is to produce a user access compartment module which is economical to manufacture, simple and safe to operate, and which provides security for the cash which is stored within a cash dispensing machine.

Another feature of this invention is that the module is capable of transferring currency from a dispensing compartment within the module to a currency bin located within the machine instead of delivering the currency to a customer whenever the machine detects that a mis-count has occurred in the currency dispensing process.

An additional feature of this invention is that the module includes a protective door which opens to permit access to cash to be dispensed and which closes after a predetermined time; however, if upon closing, the door encounters an obstacle, like a customer's hand, the door will automatically open to permit the customer to remove his hand. After another period of time has elasped, the door will close.

The following are representative of the prior art:

Ser. No. 905,401; U.S. Pat. Nos. 3,635,321; 1,260,578; 3,651,986; 1,885,165; 3,675,816; 1,885,560; 3,702,101; 1,924,330; 3,710,976; and 3,784,090.

Summary of the Invention

This invention relates to an automatic teller machine or a cash dispensing machine which incorporates a user access compartment module therein. The machine includes transaction entry means, cash authorization means, currency counting and dispensing means, receipt issuing means, control means, and a panel having an opening therein through which the cash is dispensed. The module includes a frame means for securing the module inside the machine near said opening and a compartment means having a first support means for pivotally mounting the compartment means along its longitudinal axis in the frame means. First drive means are used to rotate the compartment means (into which an item like cash and/or a receipt are deposited) between a cash or item receiving position and a cash or item dispensing position, and associated first latch means are used for selectively locking the compartment means in the two said positions. An accurately shaped door has a second support means for pivotally mounting the door in the frame means for rotation on said axis. Second drive means are used for rotating the door between first and second positions which repsectively close and open and opening in the panel of the machine. Second latch means are used for selectively locking the door in the first position, closing the opening, and for permitting the door to be moved to the second position. The currency counting and dispensing means dispenses a predetermined amount of cash into the compartment means (when in the cash receiving position) in response to a signal resulting from the inter-action of the transaction entry means, cash authorization means, and control means within the machine. The first latch means then unlocks and permits the first drive means to rotate the compartment means to the cash dispensing position where it is locked. Thereafter, the second latch means unlocks, permitting the door to be rotated to the second position by the second drive means whereby a customer can reach through the opening in the panel to obtain the cash or receipt within the compartment means. After a short time interval, the door is rotated to the first position to close the opening, at which position, the door is locked. Thereafter, the first latch means is unlocked, permitting the first drive means to rotate the compartment means past the cash receiving position to a cash dumping position, whereby any cash or items left in the compartment means are dumped into a receiving bin located within the machine. After dumping, the compartment means is left in this position where it remains until another customer inserts his card into the machine which causes the compartment means to rotate back to the cash receiving position where it is locked by the first latch means, and is readied for his use. Monitor means are used to detect the various positions of the door and compartment means which are under the control of said control means.

A more thorough understanding of the objects, features and advantages of this invention may be attained from the following description taken in conjunction with the accompanying drawings.

DETAILED DESCRIPTION OF THE INVENTION

Figure 1:
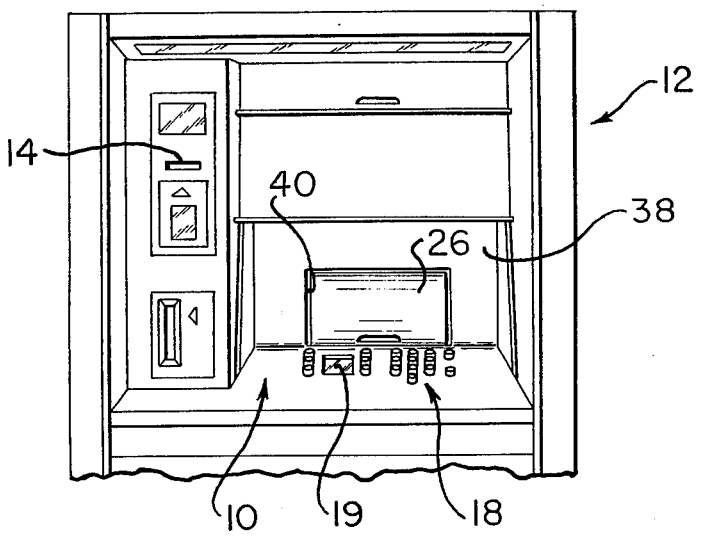
FIG. 1 is a front view, in elevation, of an automated teller machine or a cash dispensing machine or system which has incorporated therein the user access compartment of this invention, showing a card inserting opening, transaction entry means, and a dispensing opening in the protective cabinet of the machine, which opening is closed by a protective door of this invention.

FIG. 1 is a front view of a control panel of an automated teller machine or a cash or currency dispensing machine in which the user access compartment of this invention is incorporated. The control panel, designated generally as 10, is located at the front of the machine, and is made of a suitable sturdy material like steel so as to satisfy the security requirements of the banking industry. The panel 10 is fitted into a protective cabinet 12 which is similarly made of sturdy material to provide security for the cash which is stored therein. The cabinet 12 may be of the free-standing type or may be of the type which is mounted, for example, into a brick wall, located in a bank lobby. One of the panels (not shown) of the cabinet has a door (similar to the door on a safe) which may be opened by bank officials for servicing the machine for normal banking functions, like replenishing the supply of cash therein and updating the accounts for the previous transactions stored therein, or for maintenance and repair work to the machine itself. Because these matters may be conventional, they are not discussed in further detail.

Before proceeding with a detailed description of the user access compartment of this invention, it appears appropriate to discuss in very general terms, the operation of the machine in relation to a customer using the machine to obtain cash in response to a valid transaction.

Generally, in order to initiate a transaction, it is necessary for a customer to insert a credit card or token into the machine. The control panel 10 has a slot 14 into which the credit card is inserted. The car may be a card similar to the standard credit card having embossed, human-readable characters on one side thereof and also having a magnetic stripe or stripes containing the account number, credit limit, etc. on the other side thereof. Suitable notches (not shown) in the slot 14, which notches are complementary to the embossed characters on the card, enable the car to be inserted into the machine in only one direction so as to enable the magnetic stripe or stripes thereon to be aligned in reading relationship with a conventional magnetic card reader located within the machine, which reader is part of a credit card authorization means 16. Once inserted into the machine, the magnetic stripe on the card is read and the pertinent data thereon like account number, credit limit, etc. are extracted for processing by the machine. It may be necessary for the customer to enter into the machine certain code number which identify him as a valid user of the machine. Transaction entry means 18, including a keyboard, may be used for this purpose. The customer also enters upon the entry means 18, the type of transaction he wishes the machine to perform. In the example given, the customer would enter the amount of cash to be withdrawn, like $50.00, and then he depresses a transaction key (like "cash withdrawal"). A message window 19 displays various amounts and "lead-through" messages to instruct the customer in the operation of the machine or to inform him of the status of his transaction.

After the customer depresses the case withdrawal key or a similar actuating key, a control unit 20 within the machine coordinates the sequence of events for completing the transaction. Assuming that the credit card is valid and the customer has an account from which he is authorized to withdraw the amount of the cash transaction, $50.00, a cash or currency dispenser 22 (FIG. 3) within the machine will respond by depositing $50.00 in currency in a compartment 24. Various receipts may also be deposited in the compartment by a conventional printer located in the machine to provide a record of the transaction. Upon completion of the dispensing operation, the compartment 24 will be rotated to a cash dispensing position shown in FIG. 5 and locked therein, and thereafter, a protective door 26 (FIGS. 6 and 1) will be unlocked and opened, permitting the customer to withdraw the cash/or receipts located within the compartment 24. His credit card and his account will be updated to reflect the cash dispensing transaction and his card will be returned to him. After a predetermined, short, time interval, the door 26 will be rotated to the closed position shown in FIG. 1 and locked therein, and the machine will be readied for the next customer.

Figure 2:
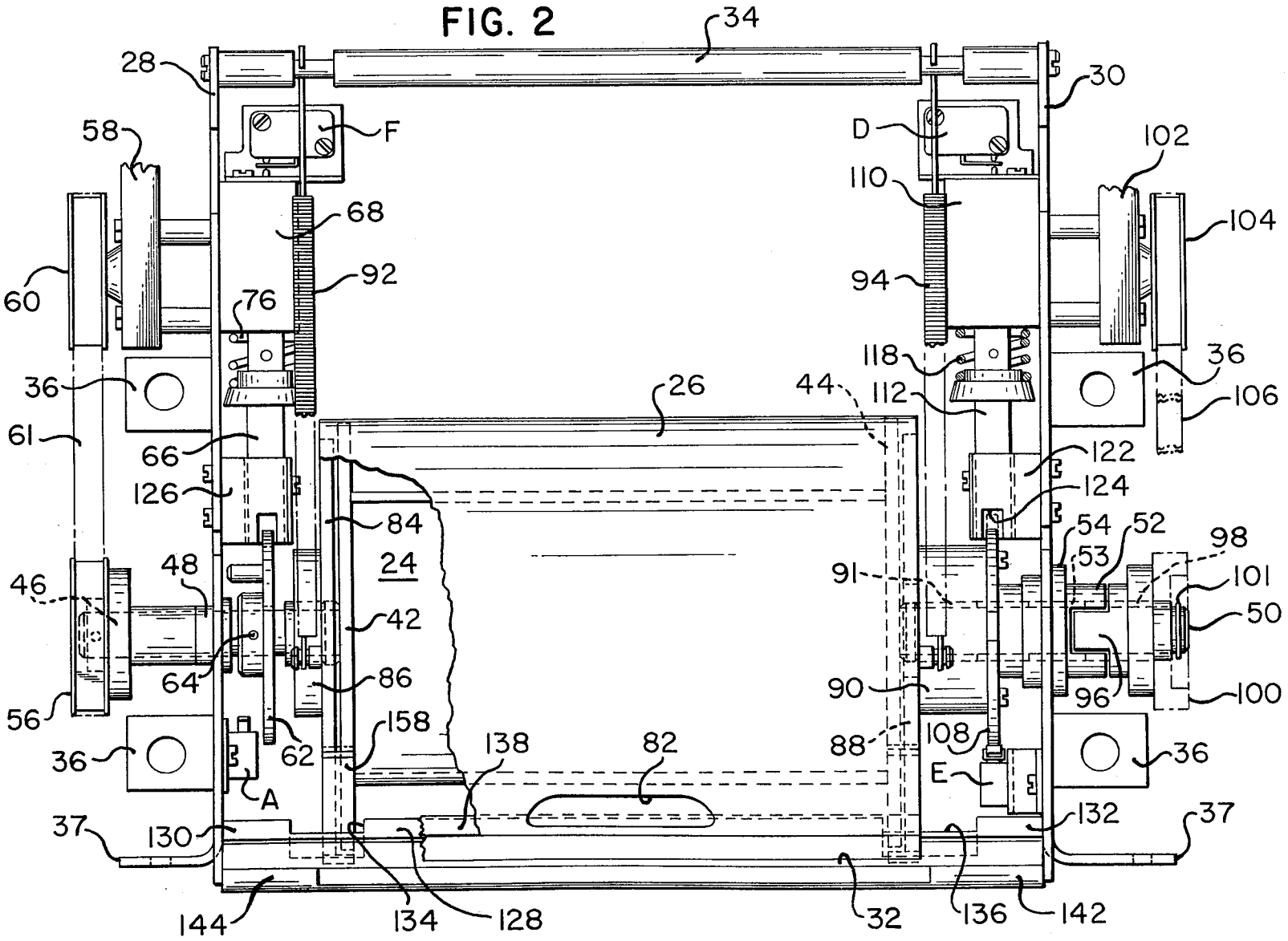
FIG. 2 is a front view, in elevation, looking at the front of the user access compartment of this invention, as seen from FIG. 1, showing the protective door closing the dispensing opening, with a portion of the door being broken away to show a compartment means located behind the door. Portions of the protective cabinet are removed to show the means for mounting the door and compartment means for pivotal movement, and driving means therefor.

The user access compartment of this invention is shown principally in FIG. 2 and is supported on a frame means which includes spaced, parallel, vertically-aligned side plates 28 and 30 which are joined together rigidly by horizontally-positioned cross bars 32 and 34. Two flanges 36, secured to side plate 28 and two additional flanges 36, secured to the side plate 80, enable the frame means to be adjustably and detachably positioned as a module on a panel 38 (FIG. 1) of the protective cabinet 12, which panel 38 has an access opening 40 therein. As an alternative construction, the flanges 37 may be secured to a carriage (not shown) which is mounted on conventional sliding guides to enable the entire module to be moved towards and away from the panel to provide for ease of maintenance through a safe-type door (not shown) located on one of the walls of the cabinet 12.

Figure 3:
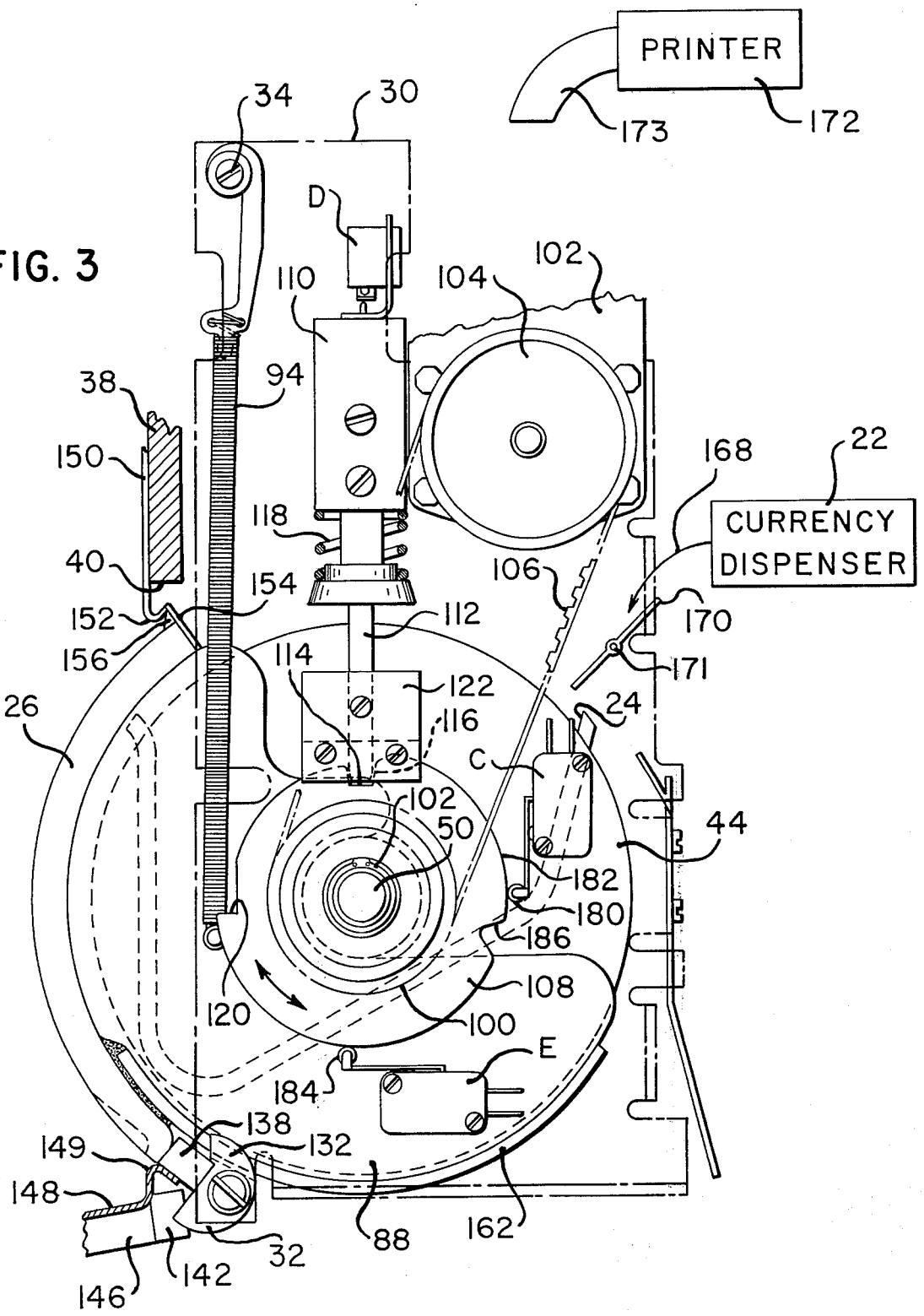
FIG. 3 is a side view, in elevation, of the high side of the user access compartment as viewed from FIG. 2, showing additional details of the door driving means and latch means transfer.

The compartment 24 is generally elongated in shape having a general U-shaped cross section as shown in FIG. 3, and has vertically positioned end walls 42 and 44 (FIG. 2) to close the ends thereof.

A first support means is used to pivotally mount the compartment 24 on the frame means and includes a first shaft 46 which has one end thereof fixed to the center of end wall 42 and is rotatably mounted between its ends in a bushing 48 which is mounted in a suitable aperture in the side plate 28. The first support means also includes a second shaft 50 which has one end thereof fixed to the center of end wall 44 and is rotatably mounted between its ends in a drive sleeve 52 having a bushing 53 therein, and which sleeve, in turn, is rotatably mounted on its periphery in a bushing 54 which is mounted in a suitable aperture in the side plate 30. The shafts 46 and 50 are axially aligned with each other and are parallel to the front panel 38 to form a horizontal axis about which the compartment 24 may be rotated by means to be later described.

A first drive means is used to rotate or pivot the compartment 24 between a cash receiving position, a cash dispensing position (to provide customer access to the currency dispensed therein), and a cash dumping position (to empty any contents remaining in the compartment into a bin located inside the cash dispensing machine).

Figure 7:
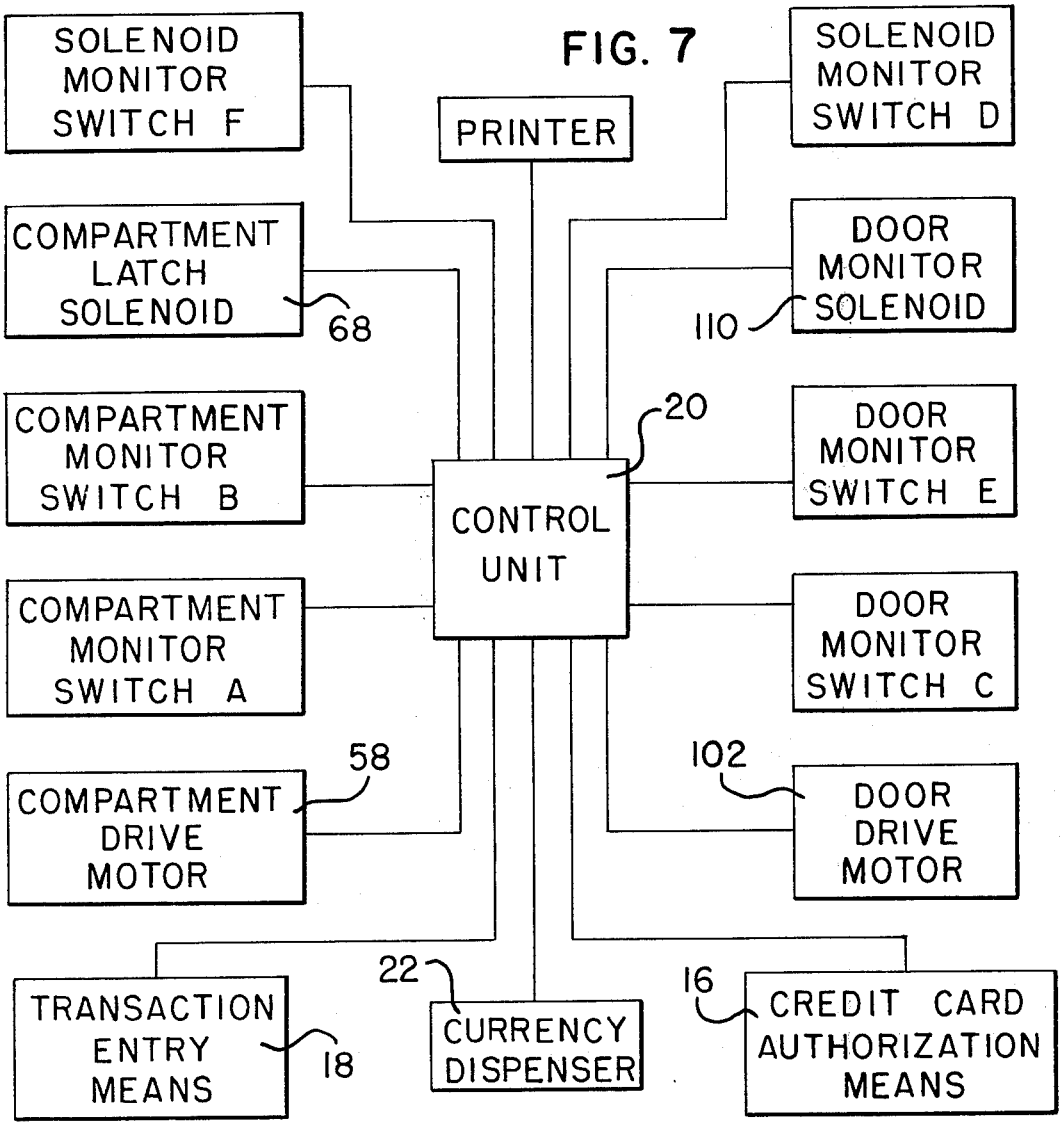
FIG. 7 is a circuit diagram, in block form, of a control means which may be used with this invention.

The first drive means includes a flanged pulley 56 (FIG. 2) which is pinned to the first shaft 46 to rotate it. A conventional reversible motor 58 and associated speed reducing unit is fixed to the side plate 28, and its output pulley 60 has an endless driving belt 61 in driving engagement with it and the flanged pulley 56 to rotate pulley 56. The direction of rotation of the motor 58 is controlled by the control unit 20 (FIG. 7).

The compartment 24 also has a first latch means (FIGS. 2, 4 and 6) associated therewith for locking it in the cash receiving, the cash dispensing, and the cash dumping positions. The first latch means includes a disc 62 which is fixed to shaft 46 (by a pin 64) to rotate therewith, and the disc has notches therein which cooperate with a plunger 66 of a compartment latch solenoid 68 to lock, unlock, and limit the movement of the compartment 24 in the various positions mentioned.

Figure 6:
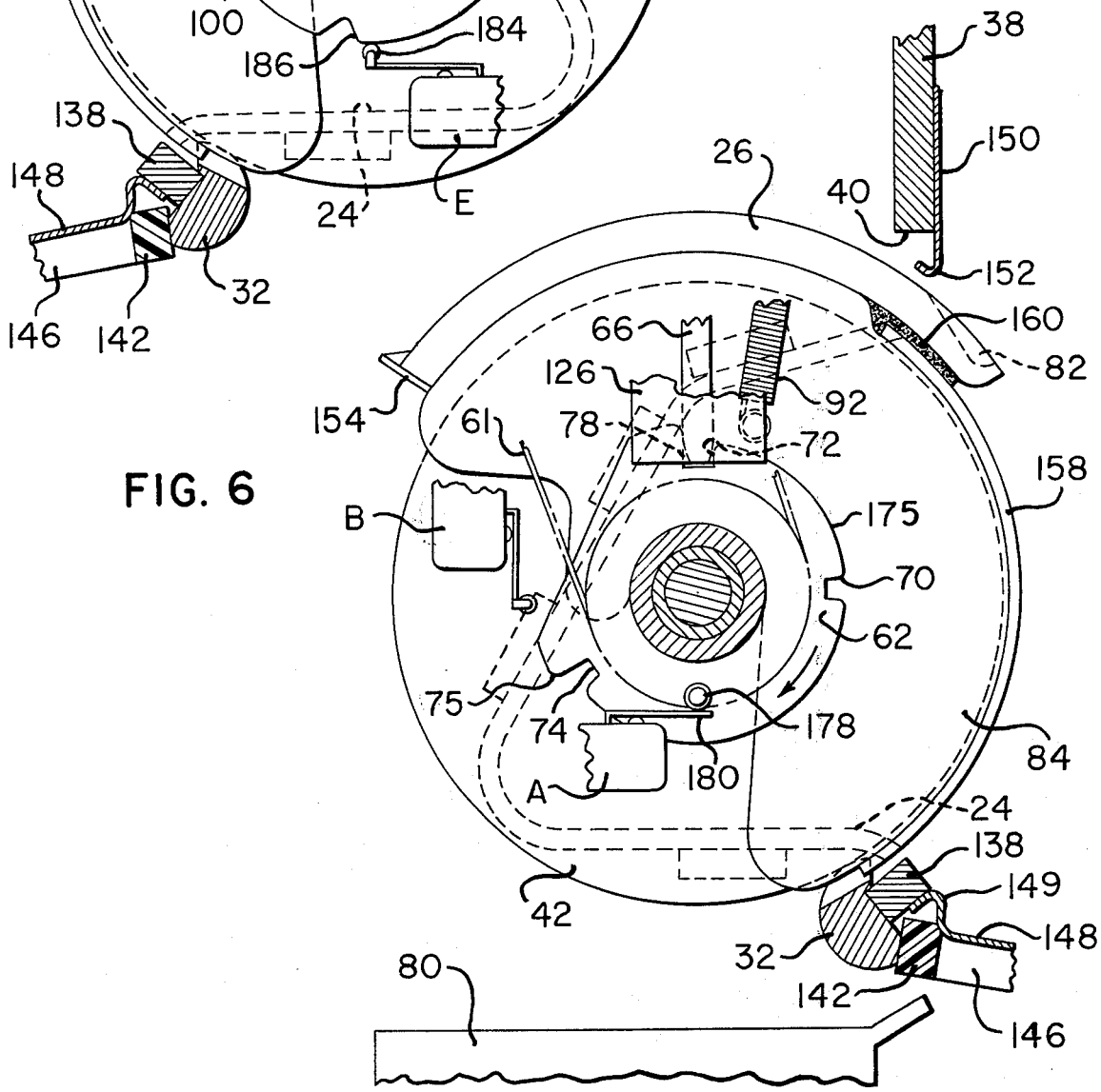
FIG. 6 is a view similar to FIG. 4 showing the protective door in the open position and the compartment means in the cash dispensing position, and also showing additional details of the associated latch means.

The disc 62 (FIG. 4) of the first latch means is generally circular in shape and has a first notch 70, a second notch 72, and a third notch 74 on the periphery thereof as shown. When the plunger 66 is in the first notch 70, the compartment 24 is locked in the cash receiving position shown in FIG. 4, and to move it to the cash dispensing position, the solenoid 68 is energized momentarily by the control unit 20, to withdraw the associated plunger 66 from the notch 70, and thereafter, the drive motor 58 is energized to rotate the compartment 24 in a clockwise direction (as viewed in FIG. 4). Because the solenoid 68 is energized only momentarily, its associated spring 76 will force the plunger 66 into riding engagement with the periphery of the disc 62 as it is rotated by the motor 58 until the plunger 66 drops into the second notch 72 as shown in FIG. 6, to lock the compartment 24 in the cash dispensing position shown. The disc 62 has a shoulder 78, adjacent to the notch 72, to prevent the compartment from being rotated beyond the cash dispensing position.

While the compartment 24 is in the cash dispensing position (FIG. 6) and the door 26 is open, a customer may remove the cash and/or receipts deposited therein, and thereafter, the door will close and lock (by means to be later described). After the door 26 is locked, the solenoid 68 is energized to withdraw the plunger 66 from the notch 72, and the compartment 24 is rotated in a counterclockwise direction by the motor 58 until the shoulder 75 on the disc 62 abuts against the plunger 66 which upon deenergization of solenoid 68, drops into the notch 74. When the rotation of the compartment 24 is completed, any cash or receipts which may be left in the compartment 24 by the customer will be dumped into a bin 80 (shown only schematically in FIG. 8) which is located within the machine. This bin 80 is accessed by the bank personnel when servicing the machine for the normal banking functions. After the contents of the compartment 24 are emptied in the bin 80, the compartment 24 remains in the dumping position shown in FIG. 8 until the machine is readied for use by another customer. As part of the readying process, the compartment 24 is rotated in a clockwise direction (as viewed in FIG. 6) by the motor 58 until the plunger 66 is forced into the notch 70 to lock the compartment 24 in the cash receiving position shown in FIG. 4 by the technique already described. Various switches associated with the disc 62 and control unit 20 are used to monitor the various positions of the compartment; however, this aspect will be discussed later herein.

The door 26 has a second support means for pivotally supporting it in the frame means for movement between open and closed positions relative to the opening 40 in the panel 38. The door 26 has the general shape of a portion of a cylindrical wall which has a radius of curvature whose center is coincident with the longitudinal rotating axis of shafts 46 and 50 which support the compartment 24. The door 26 is made of sufficiently thick steel to satisfy the named security requirements and is dimensioned to closely fit into the opening 40 in the panel 38 to prevent foreign objects from being inserted therein to obtain the cash stored within the machine. The door 26 also has a recess 82 therein (FIG. 2) to provide a gripping surface whereby a customer can lower the door, if necessary.

The second support means for the door 26 also includes a side plate 84 (FIG. 4) which is welded to the inside wall of the door 26 to prevent tampering from the side of the door and to mount the door for pivotal movement on the first shaft 46. The plate 84 is fixed to an apertured disc 86 (FIG. 2) which is rotatably mounted to the shaft 46 to mount the plate 84 perpendicular thereto. The plate 84 extends sufficiently far along the side (in the general shape of a sector of a circle of approximately 270° to provide security against tampering when the door 26 is moved to the open position shown in FIG. 6. The right side of the door 26 (as viewed in FIG. 2) is supported in the same manner as the left side is by a side plate 88 and an apertured disc 90 which is rotatably mounted on the second shaft 50 via a bushing 91. Because the door 26 is heavy and might injure a customer's hands during an uncontrolled descent to the closing position, the door 26 is counterbalanced by tension type springs 92 and 94 which each have one end secured to the crossbar 34 and the remaining end secured to the side plates 84 and 88 respectively. The drive means for moving the door 26 between the open and closed positions relative to the opening 40 in panel 38 is shown principally in FIGS. 2 and 3 and includes the drive sleeve 52 already mentioned. This sleeve 52 is cylindrical in shape and has a diametral slot passing through the center thereof, and is fixed to the disc 90 to rotate it and the door 26. A complementary driving sleeve 96, having a tongue portion fitting into the diametral slot in sleeve 52, is rotatably mounted on the shaft 50 via a bushing 98, and the sleeve 96 has a pulley 100 fixed thereto to rotate the sleeve 96. A suitable C-shaped washer 101, inserted into a complementary annular groove on the shaft 50, rotatably retains the pulley 100 thereon. A conventional reversible motor 102 and speed reducing unit is mounted on the side plate 30 to drivingly rotate a pulley 104 which has an endless belt 106 in driving engagment therewith and with the pulley 100 which pivots the door 26 between the closed and opened positions.

Figure 5:
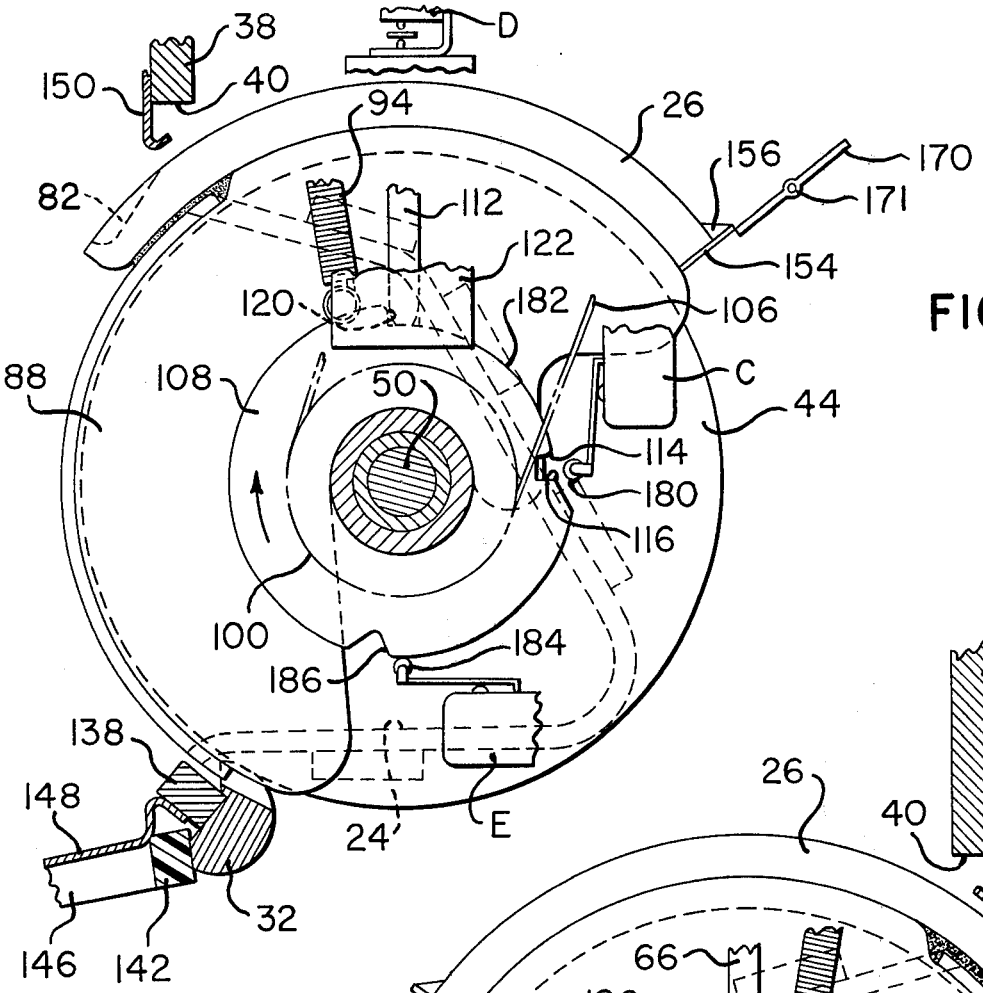
FIG. 5 is a view similar to FIG. 3, showing the protective door in the open position and the compartment means in a cash dispensing position, and also showing additional details of the associated latch means.

The door 26 also has associated therewith, a second latch means for selectively locking the door in the first or closed position shown in FIG. 3 and for permitting it to be moved to a second or open position shown in FIG. 5.

The second latch means includes a generally cylindrical disc 108 (FIG. 3) with notches therein, a shoulder on the periphery thereof, and a solenoid 110 having an associated plunger 112. The disc 108 is fixed to the disc 90 which rotates with door 26, and the disc 108 has a first notch 114 therein with a shoulder 116 located one one side thereof as shown in FIG. 3. The plunger 112 is seated in this notch 114 to lock the door in the closed position. To open the door 26, the solenoid 110 is momentarily energized by the control unit 20, and the plunger 112 is withdrawn from the notch 114 against the bias of a compression spring 118, and the motor 104 is energized to rotate the pulley 100 in a clockwise direction as viewed in FIG. 3. The door 26 is also moved in a clockwise direction by the said rotation of pulley 100, and as it approaches the open position shown in FIG. 5, the plunger 112, urged against the periphery of the disc 108, abuts against a shoulder 120 thereon to stop the door 26 in the second or open position shown. The springs 92 and 94 maintain the door in the open position until the control unit 20 indicates that it is to be closed. Usually, after a lapse of a perdetermined amount of time, like 60 seconds, for example, to enable a customer to withdraw any cash receipts or currency located in the compartment 24, the door is driven to the closed position by the motor 102 under the influence of the control unit 20. As the motor 102 rotates pulley 100 in a counterclockwise direction as viewed in FIG. 5, the plunger 112 rides on the periphery of the disc 108 until it abuts against the shoulder 116 and drops into the notch 114 due to the urging of solenoid 118, to lock the door in the closed position. The plunger 112 slidably mounted in a block 122 which is secured to the side plate 30, and the block 122 has a slot 124 (FIG. 2) therein to permit the periphery of the disc 108 to pass therethrough. The block 122 provides the necessary rigidity to the plunger 112 to enable the door 26 to be securely held in the closed position. The plunger 66 (FIG. 2) has a similar block 126 (constructed in the same manner as block 122) secured to the side plate 28 for the same reason.

As an added precaution to minimize tampering with the user access compartment and the cash dispensing machine, the crossbar 32 is specially constructed to block the entry of tampering tools underneath the closed door 26 as shown in FiGS. 2 and 3. The crossbar 32 is generally circular in cross section with the cross sectional shape of the central area 128 (FIG. 2) and the end portions 130 and 132 being that shown in FIG. 3. A notch 134 (FIG. 2) in the crossbar 32 is provided to permit the end wall 42 and side plate 84 to pass therethrough and similarly, a notch 136 in the crossbar 32 is provided to permit the end wall 44 and side plate 88 to pass therethrough. The crossbar 32 has a steel member 138 secured thereto as shown in FIG. 3 to pervent tampering tools, like crowbars from being inserted into the machine. When the user access compartment module is fitted into the cabinet 12, the crossbar 32 abuts against a resilient member 142 which is fixed to a sloping plate 146 (FIG. 3) in which the keyboard entry means 18 is located to form a weather seal. The plate 146 has a thin metal sheet 148 fixed to the top thereof, and the sheet has an end which has a reverse bend 149 (FIG. 3) therein to abut against the steel member 138. When the door 26 is in the closed position shown in FIG. 3, the lower end thereof abuts against the steel member 138 to form a tamper-proof seal therewith. The reverse bend 149 of plate 148 and the steel member 138 have a length which is equal to the length of the door 26 as measured in a horizontal direction. The upper side of opening 40 also has a weather seal associated therewith, and it includes a metal sheet 150 which is secured to the panel 38 (FIG. 3) and depends or extends into the opening 40 as shown. The lower end of sheet 150 has a reverse bend 152 therein which extends away from the door 26 as shown in FIG. 3. A plate 154 secured to the door 26 and extending in a horizontal direction along the length of the door 26 and a resilient pad 156 secured to the door 26 and also extending along the length of the door 26 cooperate with the sheet 150 to form a weather seal. The plate 154 also tends to minimize tampering with the machine.

Another added feature to eliminate tampering with the machine relates to an arcuately shaped thick metal strip 158 which is secured to the door 26 as at 160 in FIG. 6. The strip 158 has a radius of curvature which matches the curvature of plate 84 and is secured to the plate 84 along the perimeter thereof. The strip 158 has a width which is long enough to extend over the end wall 42 of the compartment 24 so as to prevent a tampering tool from being inserted into the space between the side plate 84 and end wall 42 as shown in FIG. 2. The strip 158 is not secured to the end wall 42, thereby permitting the compartment 24 to be rotated independently of the door 26. The arcuate length of strip 158 is long enough to cover the space between the side plate 84 and the end wall 42 which is exposed when the door 26 is in the open position as shown in FIG. 6. A metal 162, identical to strip 158, is fixed to the opposite side of door 26 (FIG. 3) and the side plate 88 to function in the same manner as does strip 158.

This invention also has a currency dispenser 22 associated therewith. Because the dispenser itself does not form a part of this invention any conventional prior art currency dispenser may be used, and consequently, the dispenser 22 is shown only in block form in FIG. 3. A typical prior art currency dispenser is one manufactured by De La Rue Instruments, Limited of Portsmouth, England, model M80-02-770. This particular dispenser dispenses two denominations of currency.

For example, U.S.A. currency, a five dollar bill or a one dollar bill may be dispensed in varying quantities to make up various sums of currency requested by a valid user of the machine. As the bills are dispensed from the dispenser 22, in the direction of arrow 168 (FIG. 3), they slide down a plate 170 of the dispenser 22 into the compartment 24 where they are collected until the entire sum to be dispensed is collected therein. The currency dispenser 22 has conventional currency counting devices (not shown) associated therewith to insure that the proper number of bills of each denomination making up a requested sum of money are in fact dispensed into the compartment 24. Should the currency counting devices indicate that a sum of money different from that which has been requested by a valid user has in fact been dispensed into the compartment 24, the control unit 20 will momentarily energize the solenoid 60, and will energize the motor 58 (FIG. 2), causing the pulley 56 to be rotated in the appropriate direction to rotate the compartment 24 to the internal dump position, shown in FIG. 8, as previously described. When the compartment 24 is in this position, the currency reflecting the different or improper count will be deposited in the bin 80 where it will be reclaimed by banking officials during normal bank servicing of the machine. After the currency is dumped, the compartment 24 will be rotated to the cash receiving position and locked therein as shown in FIG. 3 where the currency dispenser 22 will again be activated by the control unit 20 to again dispense the requested amount of currency.

The currency dispenser 22 is usually a separate module in the currency dispensing machine, but it is positioned close to the compartment 24 to facilitate the depositing of currency therein. The plate 170 is pivotally mounted on a rod 171 located in the dispenser 22 to enable the plate 170 to pivot to provide clearance for the door 26 when it is moved to the open position shown in FIG. 5. A spring (not shown) resiliently biases the plate 170 to the position shown in FIG. 3.

This invention may also utilize a printer 172 which prints various receipts to record the transactions initiated upon the transaction entry means 18 of the cash dispensing machine shown in FIG. 1. Because the printer 172 itself, does not form a part of this invention, any conventional prior art printer may be used herewith. One variety that is especially useful is a printer which prints the transaction data on a continuous strip of record paper which remains in the machine for use by banking officials, and also prints a receipt for use by a user of the machine. One such conventional printer is manufactured by NCR Corporation of Dayton, Ohio and is designated model M43-6-770. The printer 172 may be located above the compartment 24 as schematically shown in FIG. 3 so that the receipts which are issued therefrom, automatically drop by gravity via a chute 173 into the compartment 24. The printer 172 is operated under the control of control unit 20 in a conventional manner; consequently, no further discussion is necessary herein.

As was alluded to earlier herein, this invention also includes monitor means for monitoring the various positions of the compartment 24, the door 26, and the solenoids 68 and 110 associated with the latch means which are all under the control of control unit 20.

Figure 8:
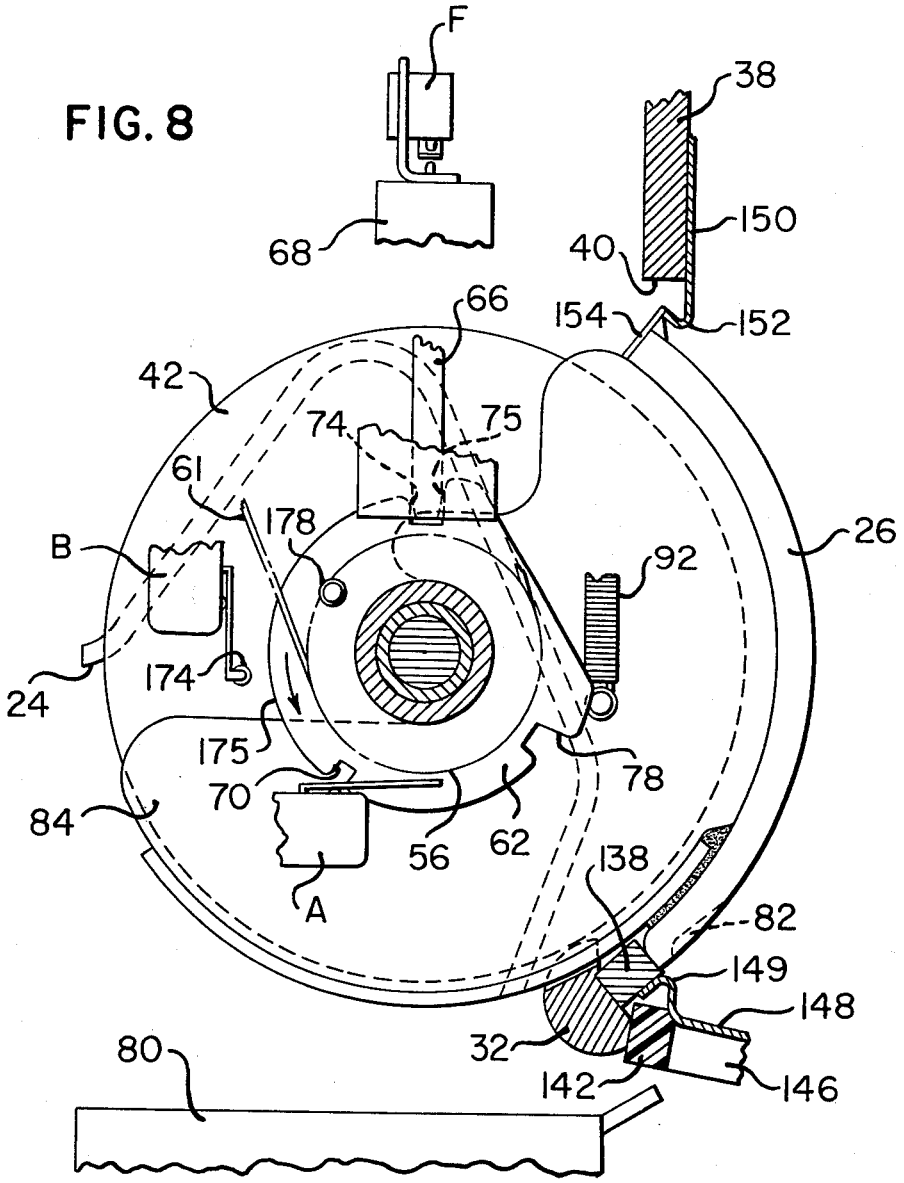
FIG. 8 is a side view in elevation, similar to FIG. 4, showing the compartment means in an internal dump position.

Assume that the compartment 24 is in the internal cash dumping position shown in FIG. 8. When in this position, a normally open switch F positioned on solenoid 68 is open when the associated plunger 66 extends into one of the notches 70, 72 and 74 on disc 62, and is closed when the plunger 66 rides on the periphery 175 of disc 62. A normally closed switch B is also closed when its associated switch arm and roller 174 is out of engagement with the periphery 175 of disc 2. These switches, F when open, and B when closed, indicate that the compartment 24 is in the internal cash dumping position shown in FIG. 8.

Figure 4:
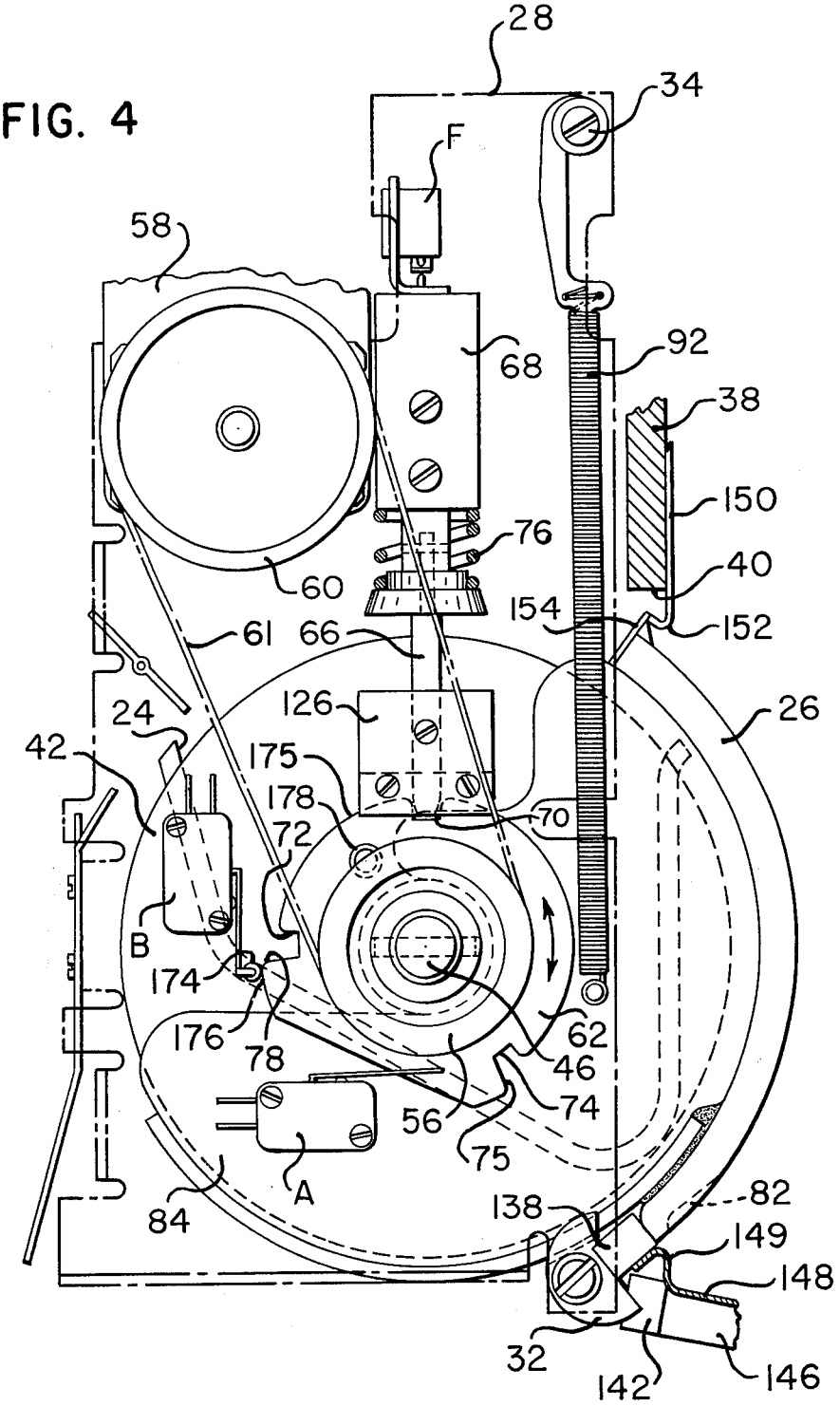
FIG. 4 is a side view, in elevation, of the left side of the user access compartment as viewed from FIG. 2 showing additional details of the driving means for the compartment means and latch means therefor.

When the machine is to be readied for a customer as previously explained, the control unit 20, which may be any conventional central processer or computer, momentarily energizes solenoid 68 and energizes motor 58 to rotate the compartment to the cash receiving position shown in FIG. 4. Upon reaching this position, plunger 66 will drop into notch 70 and a raised portion 176 on the periphery of disc 62 coacts with switch arm and roller 174 to open switch B. In the position shown in FIG. 4, the combination of switch B being open and switch F being open, indicates that the compartment 24 is locked in the cash receiving position.

When the compartment 24 is to be rotated to the cash dispensing position as previously described, the solenoid 68 is again momentarily energized and motor 58 is also energized to rotate the compartment 24 in the clockwise direction as shown in FIG. 6. When in the cash dispensing position, a stud 178 carried by the disc 62 coacts with an arm 180 of a normally closed switch A to open the switch, and when the plunger 66 drops into notch 72, the associated switch F is also opened, and these two switches indicate to the control unit 20 that the compartment 24 is in the cash dispensing position.

The door 26 also has monitor switches associated with it so that the status of the door 26 can also be ascertained by the control unit 20. When the door 26 is in the closed position as shown in FIG. 3, plunger 112 of solenoid 110 is in notch 114 and a normally open switch D operatively connected to the plunger 112 indicates the status of the plunger 112. A normally open switch C, having a switch arm roller 180 to ride on the periphery of 182 of disc 108 is also used. When the door 26 is in the closed position shown in FIG. 3, switch D is open and switch C is closed to indicate to the control unit 20 that the door is locked. When the door 26 is rotated to the open position by the techniques already described, the plunger 112 will ride on the periphery 182 and the associated switch D will be closed, and switch C will be open also due to the switch arm roller 180 being aligned with the notch 114 as shown in FIG. 5. With switch D being closed and switch C being open, the control until 20 will be informed that the door 26 is in the open position.

As the door 26 is rotated from the closed to the open position shown in FIG. 5, a normally open switch E is provided to provide additional flexibility to this invention. Switch E has a switch arm roller 184 which also rides on the periphery 182 of disc 108, and the disc also has a notch 186 therein. As the door approaches the open position shown in FIG. 5, the roller 184 is spring urged into the notch 186 on disc 108 to open switch E once, and then it is closed again as the door 26 reaches the opened position. The door 26 remains in the opened position for a predetermined amount of time like 60 seconds to enable a customer to withdraw any cash and/or or receipt in the compartment 24, and thereafter the door 26 will close automatically upon a command from the control unit 20 according to the techniques already described. Should a customer wish to hasten the process of closing the door 26 instead of waiting for the door 26 to close automatically, he simply pulls the door 26 down by inserting a few fingers in the notch 82 to pull it down. As soon as he begins to move the door 26 toward the closing position, roller 184 will be spring urged into the notch 186 to again open the switch E. This second opening of switch E is utilized by the control unit 20 to energize the motor 102 to complete the closing of door 26 as previously described. The first opening of switch E which occurs when the door 26 is moving towards the open position is ignored by the control unit 20. This feature shortens the time during which a customer must wait to receive his updated credit card upon the completion of a transaction, yet provides sufficient time for slower customers to remove any cash or receipt from the compartment 24.

What is claimed is:

1. In an automated teller machine having a protective cabinet means having an opening therein through which items like cash and receipts can be dispensed, the improvement comprising:

a dispensing module positioned in said machine adjacent to said opening;

said module having a compartment means pivotally mounted therein, for receiving and dispensing said items, and having means for rotating said compartment means between a receiving position and dispensing position relative to said opening in response to a control means;

a protective door means pivotally mounted in said dispensing module and having means for rotating said door means between closed and opened positions which close and open said opening respectively in response to said control means so as to enable a user of said machine to gain access to said items when said door means is in said opened position and said compartment means is in said dispensing position;

said means for rotating said compartment means including first latch means for selectively locking said compartment means in said receiving and dispensing positions and first drive means;

said means for rotating said door means including second latch means for selectively locking said door means in said closed position and for resiliently holding said door means in said opened position and second drive means;

said compartment means and said door means having a common axis of rotation, and said door means being arcuately shaped;

said first latch means and said first drive means being effective to unlatch said compartment means and rotate the compartment means for the receiving position to said dispensing position where the compartment means is locked prior to the second latch means unlocking said door means and the second drive means rotating said door means to said open position in response to said control means; and said second latch means and second drive means being effective to rotate said door means from said second position to said first position where it is locked prior to said first latch means and first drive means respectively unlocking said compartment means and rotating said compartment means from said dispensing position to said receiving position in response to said control means.

2. In an automated teller machine having a protective cabinet means having an opening therein through which items like cash means having an opening therein through which items like cash and receipts can be dispensed, the improvement comprises:

a dispensing module positioned in said machine adjacent to said opening;

said module having a compartment means pivotally mounted therein, for receiving and dispensing said items, and having means for rotating said compartment means between a receiving position and dispensing position relative to said opening in response to a control a protective door means pivotally mounted in said dispensing module and having means for rotating said door means between closed and opened positions which close and open said opening respectively in response to said control means so as to enable a user of said machine to gain access to said items when said door means is in said opened position and said compartment means is in said dispensing position:

said means for rotating said door means enabling said door means to remain in said opened position for a predetermined amount of elasped time prior to automatically closing said door means upon the expiration of said elapsed time, and for enabling a user of said machine to selectively initiate closing said door means prior to the expiration of said elapsed time.

3. The improvement as claimed in claim 2 in which said means for rotating said compartment means enable said compartment means to be also rotated to a dumping position whereby items in said compartment means may be dumped into a bin located within said machine upon command from said control means.

4. The improvement as claimed in claim 3 further comprising means for monitoring the various said positions of said compartment means and said door means.

5. A cash dispensing system comprising:

a protective cabinet means having an opening therein through which cash is dispensed;

cash authorization means;

compartment means pivotally mounted in said cabinet means for receiving and dispensing cash and having means for rotating said compartment means between a receiving position and a dispensing position relative to said opening;

a protective door means pivotally mounted in said cabinet means and having means for rotating said door means between closed and opened positions which close and open said opening, respectively;

control means;

cash dispensing means in said cabinet means for dispensing an amount of cash into said compartment means when in said receiving position in response to a signal derived from said cash authorization means and said control means;

said means for rotating said compartment means being effective to rotate said compartment means to said dispensing position in response to said control means, and said means for rotating said door means being effective to rotate said door means to said opened position in response to said control means to enable a user of said system to gain access to said amount of cash in said compartment means;

said means for rotating said compartment means including first latch means for selectively locking said compartment means in said receiving and dispensing positions;

said means for rotating said door means including second latch means for selectively locking said door means in said closed position and for resiliently holding said door means in said opened position; and said means for rotating said door means enabling said door means to remain in said opened position for a predetermined amount of elapsed time prior to automatically closing said door means upon the expiration of said elapsed time, and to enable a user of said system to selectively initiate closing said door means prior to the expiration of said elapsed time by manually moving said door means toward said closed position.

6. The system as claimed in claim 5 further including a printer means positioned in said cabinet means for printing a transaction receipt in response to said cash authorization means and said control means and for dispensing said receipt into said compartment means when said compartment means is in said receiving position.

7. The system as claimed in claim 6 further comprising means for monitoring the various said positions of said compartment means and said door means.

8. A cash dispensing system comprising:

a protective cabinet means having an opening therein through which cash is dispensed;

cash authorization means;

compartment means and first support means for pivotally mounting said compartment means on an axis located in said cabinet means;

first drive means for rotating said compartment means between a cash receiving position and a cash dispensing position; and first latch means for selectively locking said compartment means in said two positions;

a protective door and second support means for pivotally mounting said door on said axis;

second drive means for rotating said door between first and second positions which respectively close and open said opening in said cabinet means; and section latch means for locking said door in said first position;

control means; and cash dispensing means for dispensing an amount of cash into said compartment means in response to a signal derived from said cash authorization means and said control means;

said first latch means and said first drive means being effective to unlatch said compartment means and rotate the compartment means from the cash receiving position to said cash dispensing position where the compartment means is locked prior to the second latch means unlocking said door and the second drive means rotating said door to said open position in response to said control means;

said second latch means and second drive means being effective to rotate said door from said second position to said first position where it is locked prior to said first latch means and first drive means respectively unlocking said compartment means and rotating said compartment means from said cash dispensing position to said cash receiving position in response to said control means;

said second drive means and said second latch means being effective to enable said door to remain in said second position for a predetermined amount of elapsed time prior to automatically closing said door upon the expiration of said elapsed time, and to enable a user of said system to selectively initiate closing of said door prior to the expiration of said elapsed time by simply moving said door a short distance in the direction of said first position.

9. the cash dispensing system as claimed in claim 8 in which said container means is generally U-shaped in cross section and said door is generally arcuately-shaped having a radius of curvature which intersects said axis; said door, when in said open position relative to said opening, being located between said container means and said cash dispensing means to close off access to said cash dispensing means from said opening.

10. The system as claimed in claim 8 further including a receipt issuing means positioned in said cabinet means for printing a transaction receipt in response to said cash authorization means and said control means, and for dispensing said receipt into said compartment when said compartment means is in said cash receiving position.

11. A user access compartment module for an automated teller machine having:

a panel with a dispensing opening therein;

transaction entry means, cash authorization means, receipt printing means, cash dispensing means and control means;

said module comprising:

frame means with connection means for securing said frame means inside said machine near said opening;

a compartment means having a container means and first support means for pivotally mounting said container means on said frame means on a longitudinal axis therein;

first drive means for rotating said compartment means between a cash receiving position and a cash dispensing position;

first latch means for selectively locking said compartment means in said two positions;

a protective door having second support means for pivotally mounting said door in said frame means for rotation on said axis;

second drive means for rotating said door between first and second positions which respectively close and open said opening in said panel;

second latch means for selectively locking said door in said first position and for permitting it to be moved to said second position;

said cash dispensing means dispensing a predetermined amount of cash into said compartment means when in said cash receiving position in response to said amount being entered on said transaction entry means and to a signal derived from said cash authorization means and said control means;

said first latch means and said first drive means being effective to respectively unlock said compartment means and rotate it to said cash dispensing position where the compartment means is locked prior to the second latch means unlocking said door and the second drive means rotating said door to said open position, in response to said control means, whereby the cash within the container means may be manually withdrawn through said opening;

said second drive means for rotating said protective door enabling said protective door to remain in said second position for a predetermined amount of elapsed time prior to automatically closing said protective door upon the expiration of said elapsed time, and for enabling a user of said machine to selectively initiate closing said protective door prior to the expiration of said elapsed time.

12. The module as claimed in claim 11 in which said first support means includes first and second axially aligned shafts extending from opposed sides of said compartment means with means for rotatably mounting said shafts in said frame means;

said shafts having longitudinal axes which are coincident with said first named axis; and said door being shaped in the form of a section of a cylindrical wall with said setion being large enough to close said opening and having a longitudinal axis which is coincident with said first named axis; said door also having first and second ends;

said second support means comprising:

a first lever means which has one end fixed to said first end of said door and has the remaining end rotatably mounted on said first shaft; and a second lever means which has one end fixed to said second end of said door and has the remaining end rotatably mounted on said second shaft to enable said door to rotate concentrically with respect to said compartment means.

13. The module as claimed in claim 11 in which said container means is generally U-shaped in cross section and said door is arcuately-shaped having a radius of curvature which intersects said axis; said door, when in said open position relative to said opening, being located between said compartment means and said cash dispensing means to close off access to said cash dispensing means from said opening.

14. The module as claimed in claim 11 in which said first latch means comprises:

a first disc fixed to said first shaft to rotate therewith and having first and second notches therein;

a first solenoid means having a plunger which cooperates with said notches on said first disc to lock said compartment means respectively in said first and second positions upon command from said control means.

15. The module as claimed in claim 14 in which said second latch means comprises:

a second disc fixed to said second shaft to rotate therewith and having a notch therein and a shoulder thereon;

second solenoid means having a plunger which cooperates with said notch and said shoulder on said second disc to respectively lock said door in said first position and stop said door at said second position.

16. The module as claimed in claim 15 in which said first disc has a third notch therein to cooperate with said first solenoid means to enable said compartment means to be locked in a third position from which any items remaining in said compartment means will be dumped into a bin located inside said machine.

17. The module as claimed in claim 16 further comprising monitoring means cooperating with said first and second latch means to indicate to said control means the various said positions of said compartment means and said protective door.

* * * * *

UNITED STATES PATENT OFFICE

CERTIFICATE OF CORRECTION

PATENT NO. : 3,957,173

DATED : May 18, 1976

INVENTOR(S) : Melvin T. Roudebush

It is certified that error appears in the above-identified patent and that said Letters Patent are hereby corrected as shown below:

Column 12, line 3, delete "means having an opening therein".
Column 12, line 4, delete "through which items like cash".
Column 12, line 13, after "control" insert --means; and--.
Column 14, line 5, delete "the" and substitute --The--.

Signed and Sealed this

Twelfth Day of April 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,957,173 Dated May 18, 1976

Inventor(s) Melvin T. Roudebush

It is certified that error appears in the above-identified patent and that said Letters Patent are hereby corrected as shown below:

Column 13, line 40, "section" should read -- second --.

Column 15, line 11, "setion" should read -- section --.

Signed and Sealed this

Fourteenth Day of June 1977

[SEAL]

*Attest:*

RUTH C. MASON
*Attesting Officer*

C. MARSHALL DANN
*Commissioner of Patents and Trademarks*